US005111834A

United States Patent [19]

O'Brien

[11] Patent Number: 5,111,834

[45] Date of Patent: May 12, 1992

[54] PAINT ROLLER FLUSHING STAND

[76] Inventor: Gene E. O'Brien, 736 Catalpa Ave., St. Louis, Mo. 63119

[21] Appl. No.: 666,341

[22] Filed: Mar. 8, 1991

[51] Int. Cl.[5] ..... B08B 3/04

[52] U.S. Cl. ..... 134/137; 134/150; 134/166 R; 134/170; 134/900; 248/180

[58] Field of Search ..... 134/150, 201, 900, 87, 134/92, 118, 137, 152, 166 R, 170, 198; 248/180; 118/408, 428; 354/326

[56] References Cited

U.S. PATENT DOCUMENTS

| | | | |
|---|---|---|---|
| 431,036 | 7/1890 | Dawson . | |
| 542,954 | 7/1895 | Feely . | |
| 2,819,483 | 1/1958 | Macaulay | 15/121.2 |
| 3,431,574 | 3/1969 | Mathieu | 15/104.92 |
| 3,577,280 | 5/1971 | George | 134/138 |
| 3,587,599 | 6/1971 | Bywater | 134/900 X |
| 3,587,599 | 6/1971 | Bywater | 134/138 |
| 3,608,120 | 9/1971 | Seiler | 134/900 X |
| 4,126,484 | 11/1978 | Monteiro | 134/34 |
| 4,172,373 | 10/1979 | Lary | 68/213 |
| 4,278,031 | 7/1981 | Dangschat | 248/180 X |
| 4,334,416 | 6/1982 | Turano | 68/213 |
| 4,380,478 | 4/1983 | Cooney | 134/38 |
| 4,402,333 | 9/1983 | Frizzell et al. | 134/900 X |
| 4,517,699 | 5/1985 | Petricka | 15/104.04 |
| 4,569,497 | 2/1986 | Elmer | 248/180 X |
| 4,606,777 | 8/1986 | Brow | 134/38 |
| 4,711,258 | 12/1987 | Rossborough | 134/138 |
| 4,778,534 | 10/1988 | Nell | 134/900 X |
| 4,852,596 | 8/1989 | Fry et al. | 134/201 X |

FOREIGN PATENT DOCUMENTS

| | | | |
|---|---|---|---|
| 2949554 | 6/1981 | Fed. Rep. of Germany | 134/900 |
| 1465417 | 1/1967 | France | 134/900 |

*Primary Examiner*—Frankie L. Stinson

*Attorney, Agent, or Firm*—Senniger, Powers, Leavitt & Roedel

[57] ABSTRACT

A paint roller flushing stand for supporting a generally cylindrical paint roller having an open upper end under a faucet to facilitate flushing accumulated paint from the paint roller. The paint roller stand includes a base and a disk-shaped mounting pedestal for mounting the paint roller on the base such that the paint roller extends generally upwardly from the base with the open upper end of the paint roller facing generally upwardly. In this way, the paint roller is positioned for receiving water from the faucet into the interior of the paint roller. A leveling mechanism associated with the base can be used to selectively adjust the orientation of the paint roller to maintain portions of the paint roller surrounding the open upper end in a generally horizontal plane such that water received into the paint roller, upon filling the interior volume of the paint roller, spills over the upper end of the plant roller and down all sides thereof in generally equal volume rates.

11 Claims, 1 Drawing Sheet

FIG. 1.
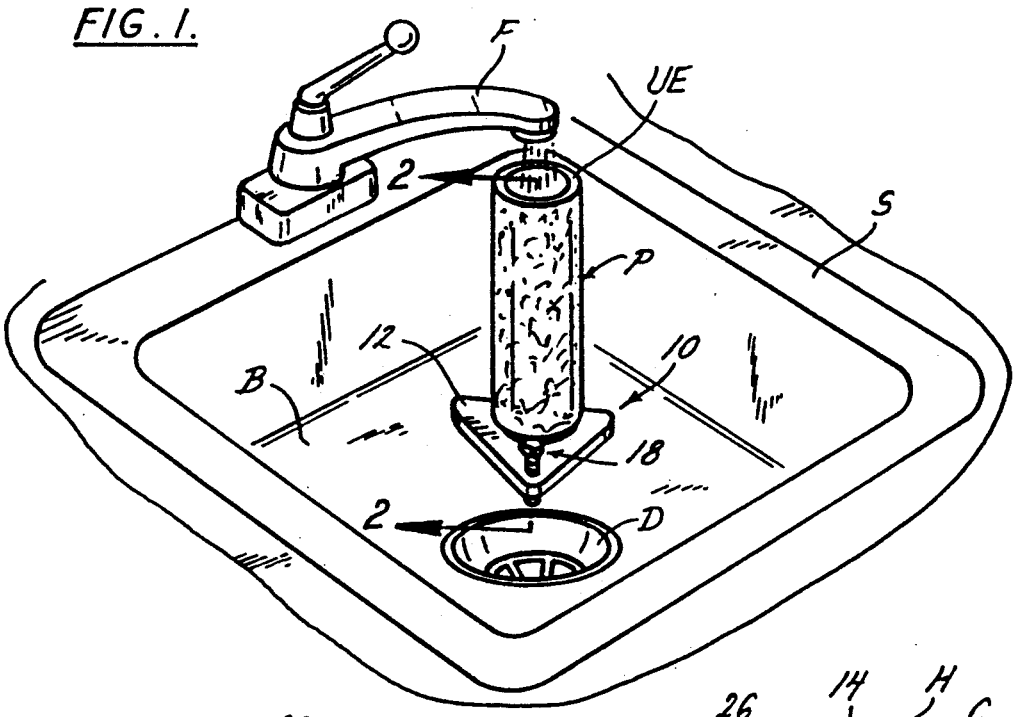
FIG. 3.
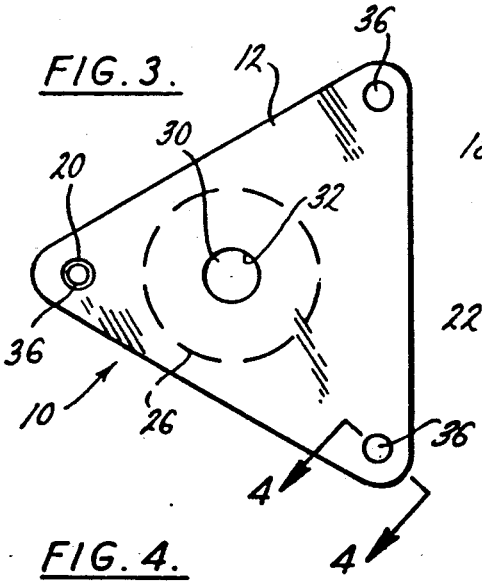
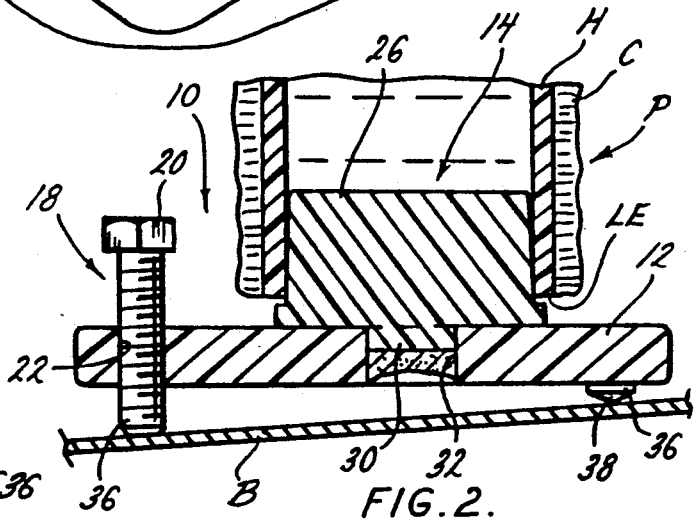
FIG. 2.
FIG. 4.
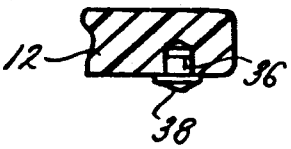
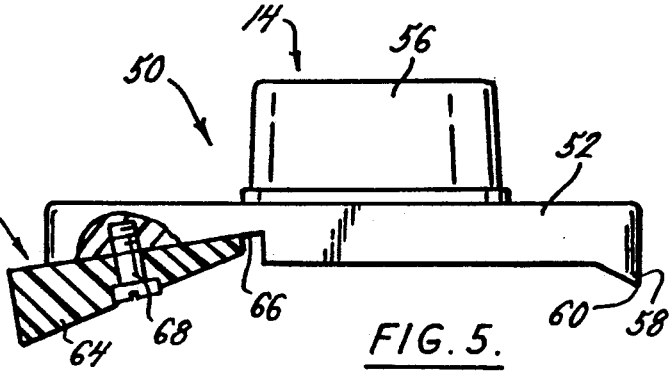
FIG. 5.
FIG. 6.
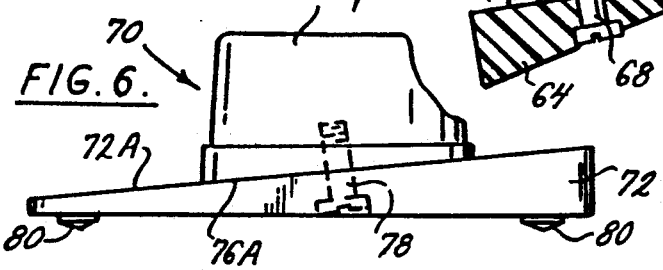

PAINT ROLLER FLUSHING STAND

BACKGROUND OF THE INVENTION

This invention relates generally to devices used in cleaning paint applicators and more particularly to a stand for use in flushing accumulated water-based paint from a paint roller.

As a paint roller is used, some of the paint which is absorbed by the roller is not applied to the surface to be painted and begins to dry on the roller. The accumulation of partially dried paint on the roller gradually reduces the amount of paint which the roller can pick up such that the paint carried by the roller is used up in shorter periods. A greater accumulation of dried paint on the roller can cause the paint to go on unevenly. Thus, to maintain the paint roller in peak operating condition, it is important to periodically clean the paint roller.

The paint roller may be cleaned in a sink under a faucet, when water-based paints are used. However, cleaning the paint roller manually requires a lot of time and effort which might otherwise be spent painting. It is possible to clean the paint roller by flushing its cylindrical exterior surface with water for a period of time. No manual cleaning effort is needed, and flushing can be carried out unattended. A primary concern with unattended cleaning of the roller is that substantially equal amounts of water be applied to all portions of the exterior surface of the roller to uniformly clean the exterior surface. Devices which facilitate unattended flushing of the paint roller are shown in U.S. Pat. Nos. 4,172,373, 4,126,484 and 3,577,280. In the past paint roller flushing devices have generally been relatively large and incorporated connections for supply of water from a faucet or hose to a roller container. There is presently a need for a device to facilitate paint roller flushing which is small, simple in design and yet provides for uniform flushing of the entire exterior surface of the paint roller.

SUMMARY OF THE INVENTION

Among the several objects and features of the present invention may be noted the provision of a paint roller flushing stand which can hold a roller in a sink so that the entire exterior surface of the roller is uniformly flushed; the provision of such a paint roller stand which is small; and the provision of such a paint roller stand which is simple in design and may be inexpensively manufactured.

Generally, a paint roller stand constructed according to the principles of the present invention comprises a base and means for mounting the paint roller on the base such that the paint roller extends generally upwardly from the base with an open upper end of the paint roller facing generally upwardly such that the paint roller is positioned for receiving water from the faucet into the interior of the paint roller. Leveling means associated with the base provides for selective adjustment of the orientation of the paint roller to maintain portions of the paint roller surrounding its open upper end in a generally horizontal plane. Thus, water received into the paint roller, upon filling the interior volume of the paint roller, spills over the upper end of the paint roller and down all sides thereof in generally equal volume rates.

Other objects and features of the present invention will be in part apParent and in part pointed out hereinafter.

BRIEF DESCRIPTION OF THE DRAWINGS

FIG. 1 shows a paint roller flushing stand constructed according to the principles of the present invention;

FIG. 2 is a sectional view taken in the plane including line 2—2 of FIG. 1;

FIG. 3 is a bottom plan view of the paint roller stand;

FIG. 4 is a fragmentary sectional view of a corner of the paint roller stand from the perspective indicated by line 4—4 of FIG. 3;

FIG. 5 is an elevational view, with parts shown in section to reveal details, of a paint roller flushing stand of a second embodiment; and FIG. 6 is an elevational view of a paint roller flushing stand of a third embodiment.

Corresponding reference characters indicate corresponding parts throughout the several views of the drawings.

DETAILED DESCRIPTION OF THE PREFERRED EMBODIMENTS

Referring now to the drawings, and in particular to FIG. 1, a paint roller flushing stand 10 of a first embodiment of the present invention is shown supporting a paint roller P in a sink S under a faucet F to facilitate flushing accumulated paint from the paint roller. The paint roller P is generally cylindrical in shape, hollow and has an open upper end UE and an open lower end LE. The paint roller typically includes a cylindrical holder H covered with a soft, absorbent material such as lambs wool C or the like. The paint roller P and stand 10 are positioned directly under the faucet F so that water from the faucet pours through the open upper end UE of the roller and into its hollow interior. Once the interior volume of the paint roller P is filled with water, it spills over the open upper end UE of the roller and down the sides, flushing accumulated paint from the roller. It has been found that a relatively small total volume of water passing over the sides of the paint roller P is sufficient to flush the semi-dry paint from the roller. If allowed to flush for a period of time (e.g., two to three hours) all of the accumulated, semi-dry paint in the roller can be washed away without any manual effort.

As shown in FIG. 2, the paint roller stand 10 includes a base 12 and mounting means 14 for mounting the paint roller P on the base. The mounting means 14 holds the paint roller so that it extends generally upwardly from the base with the open upper end UE of the paint roller facing upwardly to receive water from the faucet F, as described. The mounting means 14 also serves as a stopper to substantially seal the open lower end LE. The bottom surface B of the sink on which the stand 10 rests, is sloped toward the drain D in the sink. Different sinks will have a greater or lesser grade slope. Thus, there is a tendency for the base 12 and mounting means 14 to lie in a nonhorizontal plane so that the paint roller P projects upwardly from the base an angle to the vertical with portions of the roller surrounding the open upper end UE lying in nonhorizontal planes. This orientation of the paint roller P causes water received into the roller to spill over the low side of the roller and not the high side such that paint flushing is nonuniform of the exterior surface of the roller.

Leveling means, generally indicated at 18, associated with the base 12 allows for selective adjustment of the orientation of the paint roller P to maintain portions of the paint roller surrounding its open upper end UE in a generally horizontal plane so that water received into the hollow interior of the roller, upon filling the interior volume, spills over the upper end of the paint roller and down all sides in generally equal volume rates. In the first embodiment of the present invention, the leveling means 18 comprises a screw 20 (broadly "base support member") threadably received in a bore 22 through the base 12, adjacent one corner of the base. By turning the screw 20, one side of the base 12 may be selectively raised and lowered relative the remaining portion of the base to pivot the mounting means 14 and paint roller P about a generally horizontal axis to level the upper end UE of the roller in compensation for the slope of the sink bottom wall B. Once properly oriented, the stand 10 and paint roller P may be left unattended so that the water cascading down all sides of the roller in uniform volume rates can flush accumulated paint from the cover C.

The mounting means 14 comprises a generally disk-shaped member 26 mounted on the base 12 and projecting upwardly from the base. The disk-shaped member 26 tapers inwardly from bottom to top so that it is adapted for sliding reception in the open lower end LE of the paint roller P. As a practical matter, paint rollers are standard in their dimensions. However, the taper of the disk-shaped member 26 accommodates variations in the internal diameter of the holder H between different paint roller manufacturers. An outwardly projecting flange 28 is provided at the bottom of the disk-shaped member. The lower end LE of the paint roller will not typically engage the flange 28, but be held by frictional engagement away from the flange, as shown in FIG. 2 of the drawings. The engagement of the disk-shaped member 26 with the interior walls of the paint roller holder H restricts the flow of water through the lower end. The disk-shaped member 26 may seal the open lower end LE of the paint roller, but it is necessary only that it restrict the volume rate of flow through the open lower end to less than the volume rate of flow of water from the faucet F through the open upper end UE of the paint roller. Therefore, the disk-shaped member 26 can be made of durable, inexpensive hard plastic rather than a softer, more expensive sealing material.

A plurality of feet 36 depending from the base support the base on the bottom wall B of the sink S. As shown in FIG. 4, two of the feet 36 are pegs fit into the underside of the base 12. The feet have (inverted) conical heads 38 which engage the sink bottom wall B generally at their tips. The lower end of the screw 20 constitutes a third leg 36 for purposes of the first embodiment of the present invention. The base 12 is triangular in shape and the feet 36, as may be seen in FIG. 3, are arranged in a triangular configuration, with one foot adjacent each corner of the base. This configuration provides stability and facilitates tipping of the stand 10 to properly orient the paint roller P under the faucet F. The tips of the leg heads 38, which engage the bottom wall 38, act as a pivot point for the stand 10 as the screw 20 turned to raise or lower that corner of the base 12.

As shown in FIG. 2, the base 12 and disk-shaped member 26 are separate pieces with the disk-shaped member having an integral stud 30 which is press fit into a bore 32 in the base to connect the two together. However, the base 12 and disk-shaped member 26 can be formed as one piece, such as by molding out of plastic.

A second embodiment of the paint roller flushing stand 50, is shown in FIG. 5 to comprise a base 52, with the mounting means 14 comprising a disk-shaped member 56 substantially identical to the disk-shaped member 26 described above. The feet 58 are formed as one piece with the base 52 and engage the bottom wall B of the sink S at pointed tips 60. The leveling means 18 includes a wedge member 64 of circular cross section which is received in a wedge-shaped notch 66 on the underside of the base 52 sized to receive the wedge member. A bolt 68 mounts the wedge member 64 on the underside of the base 52 at one corner thereof so that the wedge member may be rotated relative the base. Rotation of the wedge member 64 so that its thicker portion is located at the corner of the base 52 with the thinner portion located inward of the corner tips the side of the base on which the wedge member is mounted upwardly relative the remaining portions. Conversely, rotation of the wedge member 64 so that its thinner portion is located at the corner with the thicker portion located inwardly of the corner and received in the notch 66, lowers the side of the base on which the wedge member is mounted relative the other portions of the base 52. In this manner, the stand 50 may be adjusted to maintain the open upper end UE of the paint roller P in a generally horizontal plane although the stand rests on a sloped sink bottom wall B.

A third embodiment of the paint roller flushing stand 70 of the present invention is shown in FIG. 6 to comprise a wedge shaped base 72 having a nonhorizontal, sloped upper surface 72A. The mounting means 14 comprises a disk-shaped member 76 similar to the disk-shaped member 26 described above. However, the disk-shaped member 76 of the third embodiment has a lower surface 76A a which is sloped. The disk-shaped member 76 is attached to the base 72 by a bolt 78 having an axis of rotation perpendicular to the sloped upper surface 72A of the base and sloped lower surface 76A of the disk-shaped member. As attached to the base 72, the lower surface 76A of the disk-shaped member 76 engages the sloped upper surface 52A of the base 52. The legs 86 of the stand 70 are identical to the pegs 36 described above.

The bolt 78 constitutes in this embodiment means for effecting rotation of the disk-shaped member 76 relative the base 72 about the longitudinal axis of the bolt. Rotation of the disk-shaped member 76 which positions the thicker portions of the member over the thicker portions of the base 72 tilts the paint roller P to the left (as viewed in FIG. 6). Rotation of the disk-shaped member 76 so that its thicker portion is positioned over he thinner portion of the base 72 (as is depicted in FIG. 6) tilts the paint roller P to the right. Thus, by turning the disk-shaped member 76, the paint roller P may be oriented with its open upper end UE in a level horizontal position under the faucet F.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A paint roller flushing stand for supporting a generally cylindrical paint roller having an open upper end under a faucet to facilitate flushing accumulated paint from the paint roller, the paint roller stand comprising:

a base;

means for mounting the paint roller on the base such that the paint roller extends generally upwardly from the base with the open upper end of the paint roller facing generally upwardly such that the paint roller is positioned for receiving water from the faucet into the interior of the paint roller;

leveling means associated with the base for selectively adjusting the orientation of the paint roller to maintain portions of the paint roller surrounding the open upper end in a generally horizontal plane such that water received into the paint roller, upon filling the interior volume of the paint roller, spills over the upper end of the paint roller and down all sides thereof in generally equal volume rates.

2. A paint roller stand as set forth in claim 1 wherein said leveling means comprises a base support member connected to the base, said base support member being selectively adjustable for raising and lowering one side of the base.

3. A paint roller stand as set forth in claim 2 wherein said base support member comprises a screw threadably engaged with the base.

4. A paint roller stand as set forth in claim 2 wherein said base support member comprises a wedge member mounted for rotation on the underside of the base adjacent one side thereof.

5. A paint roller stand as set forth in claim 4 wherein the base has a notch in its underside sized to receive the wedge member therein.

6. A paint roller stand as set forth in claim 1 wherein said mounting means comprises a generally disk-shaped member projecting upwardly from the base, said disk-shaped member being adapted for reception in an open lower end of the paint roller for mounting the paint roller on the base and for restricting the flow of water through the open lower end of the paint roller.

7. A paint roller stand as set forth in claim 6 further comprising a plurality of feet depending from the base.

8. A paint roller stand as set forth in claim 7 wherein the feet are located in a generally triangular arrangement.

9. A paint roller stand as set forth in claim 8 wherein the base is generally triangular in shape.

10. A paint roller stand as set forth in claim 6 wherein said disk-shaped member has a sloped lower surface abutting a sloped upper surface of the base, and wherein said leveling means comprises means for effecting rotation of said disk-shaped member relative the base.

11. A paint roller stand as set forth in claim 6 wherein the base and said disk-shaped member are formed as one piece.

* * * * *